US005437693A

United States Patent [19]

Iizuka et al.

[11] Patent Number: 5,437,693

[45] Date of Patent: Aug. 1, 1995

[54] HEAVY OIL EMULSION FUEL COMPOSITION

[75] Inventors: Masanori Iizuka; Takao Taniguchi; Kazuo Isobe; Sayuri Tamaki, all of Wakayama; Tadakazu Yamashita; Shinichi Satake, both of Kanagawa, all of Japan

[73] Assignees: Kao Corporation; Nippon Oil Company, Limited, Tokyo, Japan

[21] Appl. No.: 207,151

[22] Filed: Mar. 8, 1994

[30] Foreign Application Priority Data

Mar. 17, 1993 [JP] Japan ..... 5-057086
Aug. 24, 1993 [JP] Japan ..... 5-209232

[51] Int. Cl.[6] ..... C10L 1/32
[52] U.S. Cl. ..... 44/302; 44/445
[58] Field of Search ..... 44/302, 443, 445

[56] References Cited

U.S. PATENT DOCUMENTS

| | | | |
|---|---|---|---|
| 4,455,149 | 6/1984 | Satake et al. | 44/302 |
| 4,770,670 | 9/1988 | Hazbun et al. . | |
| 5,024,676 | 6/1991 | Moriyama et al. | 44/301 |
| 5,104,418 | 4/1992 | Genova et al. | 44/302 |
| 5,156,652 | 10/1992 | Gregoli et al. | 44/302 |
| 5,259,851 | 11/1993 | Genova et al. | 44/302 |

FOREIGN PATENT DOCUMENTS

| | | |
|---|---|---|
| 0012345 | 6/1980 | European Pat. Off. . |
| 0058605 | 8/1982 | European Pat. Off. . |
| 0117915 | 9/1984 | European Pat. Off. . |
| 0399620 | 11/1990 | European Pat. Off. . |
| 0441002 | 8/1991 | European Pat. Off. . |
| 59-081386 | 5/1984 | Japan . |
| 397788 | 4/1991 | Japan . |
| 1147867 | 5/1969 | United Kingdom . |

*Primary Examiner*—Jacqueline V. Howard
*Attorney, Agent, or Firm*—Birch, Stewart, Kolasch & Birch

[57] ABSTRACT

A heavy oil emulsion fuel composition which contains heavy oils, such as bitumen and asphalt, wherein the heavy oil emulsion fuel composition can be used as a substitute fuel for heavy fuel oils, and has an enhanced combustion efficiency to thereby reduce the content of soot, dust and nitrogen oxides after combustion, which comprises (a) 40 to 85% by weight of a heavy oil, (b) 10 to 40% by weight of water, (c) 0.1 to 5% by weight of a surfactant and (d) at least 0.1% by weight of at least one component selected from the group consisting of water-soluble compounds having in its molecule two or more hydroxyl groups, monohydric alcohols having 6 or more carbon atoms, and mixtures thereof.

11 Claims, No Drawings

HEAVY OIL EMULSION FUEL COMPOSITION

BACKGROUND OF THE INVENTION

1. Field of the Invention

The present invention relates to a heavy oil emulsion fuel composition. More particularly, it is concerned with an aqueous emulsion fuel composition comprising (a) a heavy oil, (b) water, (c) a surfactant and (d) at least one component selected from the group consisting of water-soluble compounds having in its molecule two or more hydroxyl groups, monohydric alcohols having 6 or more carbon atoms, and mixtures thereof. The emulsion fuel composition of the present invention has excellent storage stability and lesspollutive property.

2. Description of the Related Art

In recent years, there has been a demand for the development of a substitute fuel for petroleum, which is widely used as an energy source, due to the decrease in the petroleum reserve and its accompanying rise in price. Under the above-described circumstances, studies have been made to convert heavy oils, such as oil sand, bitumens, distillation residues of petroleum and asphalt, into fuel.

However, these heavy oils are usually an oleaginous material containing about 60 to 70%, and in some cases, more than 70% of a heavy fraction having a boiling point of 420° to 450° C., and in some cases, higher than 450° C. This heavy fraction of the heavy oils is usually a vacuum distillation residue, and as such, do not flow or have a viscosity as high as tens of thousands of centipoises or more. For this reason, when the heavy oils are used as a fuel, heating to a temperature as high as 280° to 300° C. is required, or else problems occur in handling, atomization, etc., as well as problems such as the clogging of the piping, etc., of the combustion boilers. As described above, the heavy oils are very difficult to use as a fuel.

In order to solve these problems, U.S. Pat. Nos. 4,249,554 (published on Feb. 10, 1981; Assignee: Conoco Inc.), 4,776,977 (published on Oct. 11, 1988; Assignee: The British Petroleum Company p.l.c.), 4,923,483 (published on May 8, 1990; Assignee: Intevep,S. A.), 4,934,398 (published on Jun. 19, 1990; Assignee: The British Petroleum Company p.l.c.), and 5,024,676 (published on Jun. 18, 1991; Assignee: Kao Corporation and Mitsubishi Jukogyo Kabushiki Kaisha), and Japanese Patent Publication-A No. 3-97,788 (published on Apr. 23, 1991) propose emulsion fuels. These emulsion fuels, however, have the problem of poor storage stability, and are not satisfactory emulsion fuels.

In addition, these heavy oils exhibit higher residual carbon and nitrogen contents than those of gas oil, kerosine and fuel oil generally used as a fuel. Therefore, when these heavy oils are used as a fuel, a serious problem arises in that the contents of soot and dust and nitrogen oxides in the exhaust gases are increased.

DISCLOSURE OF THE INVENTION

SUMMARY OF THE INVENTION

The present inventors have made extensive studies and, as a result, have found that an oil-in-water type emulsion composition comprising (a) a heavy oil, (b) water, (c) a surfactant and (d) at least one component selected from the group consisting of water-soluble compounds having in its molecule two or more hydroxyl groups, monohydric alcohols having 6 or more carbon atoms, and mixtures thereof, has a viscosity relatively close to that of water, can be sufficiently atomized at a temperature of from room temperature to 90° C., and is excellent in handleability. The present inventors have found that, by virtue of the incorporation of the water-soluble compound having in its molecule two or more hydroxyl groups and/or the monohydric alcohol having 6 or more carbon atoms, the resultant heavy oil emulsion fuel composition is excellent in fluidity, despite its very high heavy oil concentration, and has excellent stability such that neither separation nor breakage of the emulsion occurs even after storage for a long period of time. Further, the present inventors have found that the incorporation of the water-soluble compound having in its molecule two or more hydroxyl groups and/or the monohydric alcohol having 6 or more carbon atoms can contribute to a significant reduction in the levels of soot, dust and nitrogen oxides that are present in the exhaust gases and, hence, can render the emulsion fuel lesspollutive.

Thus, the present invention relates to a heavy oil emulsion fuel composition comprising or consisting essentially of (a) a heavy oil, (b) water, (c) a surfactant and (d) at least one component selected from the group consisting of water-soluble compounds having in its molecule two or more hydroxyl groups, monohydric alcohols having 6 or more carbon atoms and mixtures thereof. More specifically, the present invention relates to a heavy oil emulsion fuel composition comprising or consisting essentially of, based on the entire amount of components (a) to (d), 40 to 85% by weight of (a) a heavy oil, 10 to 40% by weight of (b) water, 0.1 to 5% by weight of (c) a surfactant and at least 0.1% by weight of (d) at least one component selected from the group consisting of water-soluble compounds having in its molecule two or more hydroxyl groups, monohydric alcohols having 6 or more carbon atoms and mixtures thereof.

In the present invention, the incorporation of a water-soluble compound having in its molecule two or more hydroxyl groups and/or a monohydric alcohol having 6 or more carbon atoms is particularly important. The water-soluble compound and/or the monohydric alcohol can impart long-term stability to an emulsion fuel composition, and contribute in making the emulsion fuel composition lesspollutive. The present inventors have also found that there exists an optimal amount of incorporation thereof. The amount of incorporation of the water-soluble compound having in its molecule two or more hydroxyl groups and/or the monohydric alcohol having in its molecule 6 or more carbon atoms is preferably in the range of from 0.1 to 49.9% by weight, still preferably in the range of from 0.1 to 30% by weight based on the entire amount of components (a) to (d), from the viewpoints of profitability and long-term stability of the emulsion fuel composition.

In the present invention, at least one component selected from the group consisting of water-soluble compounds having in its molecule two or more hydroxyl groups is preferably used as component (d). In such a case, the content of the component selected from the group consisting of water-soluble compounds having in its molecule two or more hydroxyl groups is advantageously 0.1 to 50% by weight based on the entire amount of components (a) to (d).

In the present invention, component (c) advantageously comprises a nonionic surfactant, or a nonionic surfactant and an anionic surfactant.

Further, the present invention provides a heavy oil emulsion fuel composition comprising or consisting essentially of the above-mentioned components (a) to (d) and a water-soluble polymer having a molecular weight (Mw) of 10,000 or more. The content of the water-soluble polymer having a molecular weight (Mw) of 10,000 or more is preferably 0.005 to 3% by weight, still preferably 0.01 to 2% by weight, based on the entire amount of components (a) to (d).

Furthermore, the present invention provides a heavy oil emulsion fuel composition comprising or consisting essentially of the above-mentioned components (a) to (d) and at least one component selected from the group consisting of fats and oils, fatty acids and fatty acid esters. The content of the component selected from the group consisting of fats and oils, fatty acids and fatty acid esters is preferably 1 to 50% by weight, still preferably 2 to 50% by weight based on the entire amount of components (a) to (d).

Further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Although the mechanism through which long-term stability is imparted to the emulsion fuel composition of the present invention is not clear, it is presumed to be as follows.

An emulsion comprising two liquids that are insoluble in each other, one of which is dispersed in granular form into the other liquid, gives a thermodynamically unstable nonequilibrium system because the free energy of the interface of the two liquids increases with an increase in the area of the interface of the two liquids, so that the state of dispersion varies with time toward demulsification. It is a common practice to use surfactants for the purpose of improving the stability of the system through a reduction of the free energy of the interface. However, no matter how good the performance of the surfactant, the free energy of the interface cannot be reduced to zero. Therefore, it is difficult to provide an emulsion which is truly stable.

Further, the emulsion fuel is exposed to vibrations during transportation and changes in the environmental temperature, which give rise to water separation or the breaking of the emulsion due to freezing. Therefore, it becomes very difficult to provide an emulsion fuel having long-term stability.

Under these circumstances, the present inventors have contemplated that the separation of water from the emulsion or the breaking of the emulsion due to freezing can be inhibited by regulating the structure of water. Specifically, the incorporation of a water-soluble compound having in its molecule two or more hydroxyl groups causes a hydrogen bond to be formed between the hydroxyl group of the water-soluble compound and the water molecule, so that water is changed from "free water" to "bound water". This is presumed to inhibit the separation of water from the emulsion and, at the same time, to improve resistance to freezing.

Further, the present inventors have noted the interface between water and the heavy oil and have found that the addition of a monohydric alcohol having 6 or more carbon atoms is useful in inhibiting demulsification. Namely, it is believed that a monohydric alcohol having 6 or more carbon atoms is preferentially oriented at the interface between water and the heavy oil, which lowers the interfacial free energy and enhances the stability of the system, since the monohydric alcohol is slightly soluble in both water and the heavy oil. Additionally, it is believed that a liquid crystal or a gel of the monohydric alcohol having 6 or more carbon atoms is formed at the interface between water and the heavy oil, which reduces the van der Waals force of oil droplets, the intensity of which affects dispersion and coalescence of oil droplets and is a deciding factor with respect to the stability of the emulsion.

Next, the components which are contained in the emulsion fuel composition according to the present invention will be described.

The "heavy oil" to be used as component (a) in the present invention includes the following oils which do not flow unless they are heated to high temperature, i.e., have poor flowability at ordinary temperatures.

(1) Petroleum-derived asphalt and a mixture containing the asphalt.
(2) Products, intermediate products and residues of various treatments of petroleum-derived asphalt, and mixtures containing one or more of them.
(3) High pour point oils which do not flow at ordinary temperatures.
(4) Petroleum-derived tar pitch and a mixture containing tar pitch.
(5) Bitumens, natural asphalts and Orinoco tar.

As the heavy oil, those containing components having a boiling point of 840° C. or above under atmospheric pressure in an amount of 90% by weight or more are preferable.

In the present invention, the heavy oil concentration in the emulsion fuel composition is preferably 40 to 85% by weight, still preferably 50 to 80% by weight based on the entire amount of components (a) to (d) [i.e., the total amount of components (a) to (d) being 100% by weight], to enable direct combustion and from the viewpoints of fluidity and storage stability.

Water as component (b) includes city water, deionized water and so on.

In the present invention, the water concentration of the emulsion fuel composition is important, and is preferably 10 to 40% by weight, still preferably 15 to 25% by weight based on the entire amount of components (a) to (d), to enable direct combustion and from the viewpoint of emulsion stability.

The surfactant to be used as component (c) in the present invention includes nonionic surfactants, anionic surfactants, cationic surfactants and amphoteric surfactants. In the present invention, although at least one surfactant selected from among those described above may be used, the use of a nonionic surfactant is preferable and the combined use of a nonionic surfactant with an anionic surfactant is still preferable. Examples of the surfactants include the following.

<Nonionic surfactant>

(i) An alkylene oxide adduct of a compound having a phenolic hydroxyl group, such as phenol, cresol, butylphenol, nonylphenol, dinonylphenol, dodecylphenol, p-cumylphenol and bisphenol A.

(ii) An alkylene oxide adduct of a formaldehyde condensate of a compound having a phenolic hydroxyl group, such as an alkylphenol, phenol, m-cresol, styrenated phenol and benzylated phenol, wherein the average degree of condensation is 1.2 to 100, preferably 2 to 20.

(iii) An alkylene oxide adduct of a monohydric aliphatic alcohol having 2 to 50 carbon atoms.

(iv) An alkylene oxide adduct of a monohydric aliphatic amine having 2 to 50 carbon atoms.

(v) A product of a block or random addition polymerization of alkylene oxides.

(vi) An alkylene oxide adduct of a polyhydric alcohol.

(vii) An alkylene oxide adduct of an ester of a polyhydric alcohol with a fatty acid having 8 to 18 carbon atoms.

(viii) An alkylene oxide adduct of a polyamine having a plurality of active hydrogen atoms, such as ethylenediamine, tetraethylenediamine and polyethyleneimine [molecular weight (Mw): 600 to 10,000].

(ix) A product prepared by the addition reaction of an alkylene oxide with a mixture of a fat and oil comprising a triglyceride with a polyhydric alcohol and/or water. The mixture preferably comprises 1 mol of a fat and oil comprising a triglyceride with 0.1 to 5 mol of a polyhydric alcohol and/or water.

In the above items (vi), (vii) and (ix), examples of the polyhydric alcohol include glycerol, trimethylolpropane, pentaerythritol, sorbitol, sucrose, polyglycerol, ethylene glycol, polyethylene glycol, propylene glycol and polypropylene glycol.

<Anionic surfactant>

(I) A formaldehyde condensate of a sulfonic acid of an aromatic ring compound, such as naphthalene, alkylnaphthalene, alkylphenol and alkylbenzene, or a salt thereof, wherein the average degree of condensation of formaldehyde is preferably 1.2 to 100.

(II) Ligninsulfonic acid, a salt thereof or a derivative thereof, or a formaldehyde condensate of ligninsulfonic acid and a sulfonic acid of an aromatic compound such as naphthalene and alkylnaphthalene, or a salt thereof, wherein the average degree of condensation of formaldehyde is preferably 1.2 to 50.

(III) Polystyrenesulfonic acid or a salt thereof, or a copolymer of styrenesulfonic acid with other comonomer(s) or a sale thereof, wherein the molecular weight (Mw) is preferably 500 to 500,000.

(IV) A polymer of dicyclopentadienesulfonic acid or a salt thereof, wherein the molecular weight (Mw) is preferably 500 to 500,000.

(V) A copolymer of maleic anhydride or/and iraconic anhydride with other comonomer(s), or a sale thereof, wherein the molecular weight (Mw) is preferably 500 to 500,000.

(VI) A maleinized liquid polybutadiene or a sale thereof, wherein the molecular weight (Mw) of the liquid polybutadiene as the starting material is preferably 500 to 200,000.

(VII) An anionic surfactant having in its molecule one or two hydrophilic groups and selected from the group consisting of the followings (a) to (h).

(a) a sulfuric ester salt of an alcohol having 4 to 18 carbon atoms.

(b) An $C_{4-18}$ alkane-, alkene- or alkylarylsulfonic acid or a salt thereof.

(c) a sulfate or phosphate of an adduct of a compound having in its molecule at least one active hydrogen with an alkylene oxide or a salt thereof.

(d) a sulfosuccinic acid ester salt of a saturated or unsaturated alcohol having 4 to 22 carbon atoms.

(e) an alkyldiphenyletherdisulfonic acid or a salt thereof, wherein the alkyl group has 8 to 18 carbon atoms.

(f) a rosin (or a rosin acid or a resin acid), a salt thereof, a mixed tall acid comprising a tall rosin and a tall oil fatty acid, i.e., a higher fatty acid, or a salt thereof.

(g) an $C_{4-18}$ alkane or alkene fatty acid or a salt thereof.

(h) an α-sulfofatty acid ester salt represented by the following general formula:

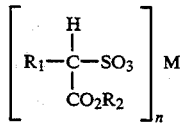

wherein $R_1$ represents an alkyl- or alkenyl group having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2.

In the compounds of groups (I) to (VII) described above, the salt is an ammonium salt, a lower amine salt such as a monoethanolamine salt, a diethanolamine salt, a triethanolamine salt and a triethylamine salt, or an alkali metal or alkaline earth metal salt such as a sodium salt, a potassium salt, a magnesium salt and a calcium salt.

<Cationic surfactant and Amphoteric surfactant>

(XI) An alkyl- and/or alkenylamine salt produced by neutralizing an alkyl- and/or alkenylamine having 4 to 18 carbon atoms with an inorganic or organic acid.

(XII) A quaternary ammonium salt represented by the following formulae (1), (2) or (3):

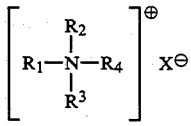

(1)

wherein $R_1$, $R_2$, $R_3$ and $R_4$ each represents an alkyl or alkenyl group having 1 to 18 carbon atoms and $X^{\theta}$ represents a counter anion,

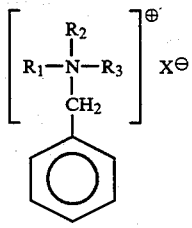

(2)

wherein $R_1$, $R_2$, $R_3$ and $X^{\theta}$ are each as defined above, and

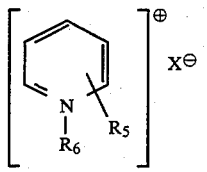

(3)

wherein $R_5$ represents an alkyl or alkenyl group having 8 to 18 carbon atoms, $R_6$ represents a hydrogen atom or a methyl group and $X^{\theta}$ is as defined above.

(XIII) An alkyl- or alkenylbetaine represented by the following formula:

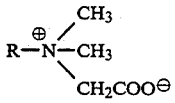

wherein R represents an alkyl or alkenyl group having 8 to 18 carbon atoms.

(XIV) An alkyl- or alkenylamine oxide represented by the following formula:

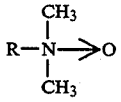

wherein R is as defined above.

(XV) An alkyl- or alkenylalanine represented by the following formula:

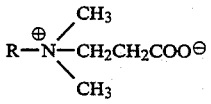

wherein R is as defined above.

(XVI) A polyamiet represented by the following formulae ( 4) or ( 5):

$$RNHC_3H_6NHY \quad (4)$$

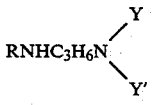

(5)

wherein R is as defined above and Y and Y' each represents an oxyethylene chain represented by the formula $$\text{-}(C_2H_4O)_m\text{-}H$$

wherein m is 1 to 50.

(XVII) A polyamine salt represented by the following formulae (6) or (7):

$$RNHC_3H_6NH_2 \cdot X' \quad (6)$$

$$RNHC_3H_6NHC_3H_6NH_2 \cdot X' \quad (7)$$

wherein R is as defined above and X' represents an inorganic or organic acid.

(XVIII) An amphoteric imidazoline surfactant represented by the following formula:

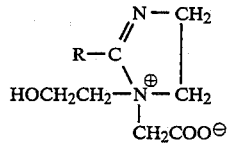

wherein R is as defined above.

(XIX) An amphoteric sulfobetaine surfactant represented by the following formula:

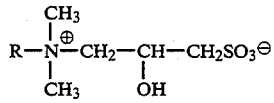

wherein R is as defined above.

In the present invention, the amount of the surfactant to be used in the emulsion fuel composition is preferably 0.1 to 5% by weight, still preferably 0.1 to 1% by weight based on the entire amount of components (a) to (d), from the viewpoints of emulsion stability and economy.

In the present invention, the water-soluble compound having in its molecule two or more hydroxyl groups as component (d) is preferably a polyhydric alcohol, and examples thereof include glycerol, polyglycerol, ethylene glycol, diethylene glycol, polyethylene glycol, propylene glycol and monosaccharides and polysaccharides such as oligosaccharide, sorbitol and glucose. Other examples of the water-soluble compound include partial esters of polyhydric alcohols. Among them, glycerol is particularly preferred.

Examples of the monohydric alcohol having 6 or more carbon atoms as component (d) include hexyl alcohol, octyl alcohol, decyl alcohol, lauryl alcohol, myristyl alcohol, cetyl alcohol, stearyl alcohol, ceryl alcohol and myricyl alcohol. Among them, monohydric alcohols having 12 to 24 carbon atoms are preferred.

As component (d), at least one water-soluble compound having in its molecule two or more hydroxyl groups may be used, at least one monohydric alcohol having 6 or more carbon atoms may be used or a mixture of at least one water-soluble compound having in its molecule two or more hydroxyl groups and at least one monohydric alcohol having 6 or more carbon atoms may be used.

In the present invention, component (d) is used preferably in an amount of at least 0.1% by weight, still preferably 0.1 to 49.9% by weight and particularly preferably 0.1 to 30% by weight based on the entire amount of components (a) to (d), from the viewpoints of profitability and long-term stability of the emulsion fuel composition.

As component (d), at least one water-soluble compound having in its molecule two or more hydroxyl groups is preferably used. In such a case, the content of the water-soluble compound(s) having in its molecule two or more hydroxyl groups is preferably 0.1 to 50% by weight based on the entire amount of components (a) to (d).

In the present invention, a water-soluble polymer may be incorporated into the heavy oil emulsion fuel composition, if necessary. That is, a water-soluble polymer having a molecular weight (Mw) of 10,000 or more is incorporated into the heavy oil emulsion fuel composition of the present invention in an amount of preferably 0.005 to 8% by weight, still preferably 0.01 to 2% by weight, based on the entire amount of components (a) to (d), to further improve the storage stability of the heavy oil emulsion fuel composition.

Examples of the water-soluble polymer that may be used include water-soluble synthetic polymers and water-soluble polymers derived from naturally occurring matter (including microorganisms). Specific examples of the water-soluble polymer are as follows:

(a) A homopolymer or copolymer of acrylic acid or a derivative thereof represented by the following formula:

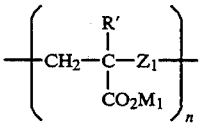

wherein R' represents a hydrogen atom, a methyl group or an ethyl group; $M_1$ represents a hydrogen atom, a sodium ion, a potassium ion, a lithium ion or an ammonium ion; $Z_1$ represents a divalent group derived from a monomer represented by the formula:

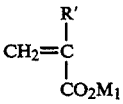

(wherein R' and $M_1$ are each as defined above), comonomer copolymerizable with the monomer or a salt (a sodium salt, a potassium salt, a lithium salt or an ammonium salt) of the comonomer, for example, maleic acid (anhydride), iraconic acid (anhydride), α-olefin, acrylamide, vinylsulfonic acid, allylsulfonic acid, methallylsulfonic acid, acrylamidomethylpropylsulfonic acid or a salt (a sodium salt, a potassium salt, a lithium salt or an ammonium salt) thereof, a dialkyl(methyl or ethyl-)aminoethylmethacrylate or a salt (chloride, diethylsulfate or dimethylsulfate) thereof; and n is 50 to 100,000.

(b) A homopolymer or copolymer of acrylamide or a derivative thereof represented by the following formula:

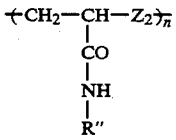

wherein R'' represents a hydrogen atom or a $C_2H_4OH$ group; $Z_2$ represents a divalent group derived from a monomer represented by the formula:

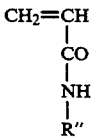

(wherein R'' is as defined above), a comonomer copolymerizable with the monomer or a salt (a sodium salt, a potassium salt, a lithium salt or an ammonium salt) of the comonomer, for example, vinylsulfonic acid, allylsulfonic acid, methallyl-sulfonic acid, acrylamidomethylpropylsulfonic acid, a dialkyl(methyl or ethyl-)aminoethylmethacrylate or a salt (chloride, dimethylsulfate or diethylsulfate) thereof, styrene, α-olefins ($C_{2-18}$) and vinylallyl alcohol; and n is 50 to 100,000.

(c) A hopopolymer of maleic anhydride or iraconic anhydride, or a copolymer thereof represented by the following formula:

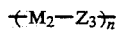

wherein $M_2$ represents a maleic anhydride or iraconic anhydride residue; $Z_3$ represents an α-olefin (ethylene, propylene, butylene, isobutylene, octene, decene, dodecene or the like) or styrene residue; and n is 50 to 100,000.

(d) A homopolymer of vinyl alcohol, or a copolymer thereof represented by the following formula:

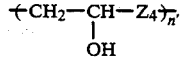

wherein $Z_4$ represents a vinyl acetate or styrene residue; and n' is 30 to 100,000.

(e) A homopolymer of vinylpyrrolidone, or a copolymer thereof represented by the following formula:

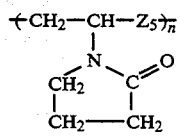

wherein $Z_5$ represents a divalent group derived from a comonomer copolymerizable with vinylpyrrolidone or a salt (a sodium salt, a potassium salt, a lithium salt or an ammonium salt) thereof, for example, acrylamide, vinylsulfonic acid, methallylsulfonic acid, maleic anhydride, iraconic anhydride, styrene, α-olefin ($C_{2-18}$) and the like; and n is 50 to 100,000.

(f) A polyalkylene oxide having a molecular weight (Mw) of 10,000 to 5,000,000 (wherein the ethylene oxide content is 95% or more). The polyalkylene oxide may contain in its molecule 5% or less of a propylene oxide, butylene oxide or styrene oxide polymer part. That is, the polyalkylene oxide may be a block copolymer. Alternatively, the polyalkylene oxide may contain in its molecule 5% or less of an alkylaryl or alkyl group.

(g) Other polymer stabilizers commonly known in the art, such as polyvinyl methyl ether, polyethyleneimine, carboxymethylcellulose, methylcellulose, hydroxyethylcellulose, cellulose sulfate, ether starch, ester starch, gum arabic, tragacanth gum, gum karaya, locust bean gum, tara gum, guar gum, tamarind gum, chitosan, sodium alginate, alginic acid/propylene glycol ester, carageenan, agar, high-methoxy pectin, low-methoxy pectin, xanthan gum, pullulan, dextran, gelatin, casein, casein sodium, hyaluronic acid and chondroitin sulfate.

Among them, polyvinyl alcohol, carboxymethyl-cellulose and xanthan gum are preferred because they have a high performance and are easily available.

In the present invention, if necessary, it is also possible to incorporate at least one component selected from the group consisting of fats and oils, fatty acids and fatty acid esters, for the purpose of further improving stability.

Examples of the fat and oil include coconut oil, palm oil, palm kernel oil, babassu oil, castor oil, linseed oil, lard, beef tallow, fish oil and tall oil.

Examples of the fatty acid include caprylic acid, captic acid, lauric acid, myristic acid, palmitic acid, stearic acid, behenic acid, oleic acid and linoleic acid.

Besides these fats and oils and fatty acids, a distillation bottom of a fatty acid produced as a by-product during the production of a fatty acid and a recovery oil of an edible fat and oil may also be incorporated, wherein the incorporation thereof is preferred from the viewpoint of effectively utilizing resources.

The amount of incorporation of at least one component selected from the group consisting of fats and oils, fatty acids and fatty acid esters is preferably, but not limited to, 1 to 50% by weight, still preferably 2 to 50% by weight, based on the entire amount of components (a) to (d).

The heavy oil emulsion fuel composition of the present invention can be produced by the conventional methods. For example, component (d) can be added by the same method as that used in the conventional nascent soap method. Preferred production methods include a method which comprises adding a water-soluble compound having in its molecule two or more hydroxyl groups and/or a monohydric alcohol having 6 or more carbon atoms to water to prepare an aqueous solution thereof, and emulsifying the aqueous solution with a mixture of a heavy oil and a surfactant, and a method which comprises preparing an emulsion comprising a heavy oil, water and a surfactant, adding a water-soluble compound having in its molecule two or more hydroxyl groups and/or a monohydric alcohol having 6 or more carbon atoms to the emulsion, and stirring the mixture. There is no particular limitation on the method and order of addition of the water-soluble polymer.

Although the mechanism by which the soot, dust and nitrogen oxides are reduced by the use of the emulsion fuel composition of the present invention has not been elucidated, it is believed to be as follows.

Asphalts and bitumens, as heavy oils, exhibit higher residual carbon and nitrogen contents than those of gas oil, kerosine, fuel oil and other oils generally used as a fuel. Therefore, when asphalts and bitumens are used as a fuel, an increase in the soot, dust and nitrogen oxide contents is unavoidable. For this reason, in order to reduce soot, dust and nitrogen oxides, it is thought to be effective to use a method wherein a fuel oil is atomized into many oil droplets to improve the contact and mixing of the fuel oil with oxygen, to thereby significantly improve combustion. By improving combustion, the occurrence of soot and dust is reduced. At the same time, it is thought to be effective to pass the atomized fuel oil through a high-temperature region for a short time to reduce the formation of thermal $NO_X$.

In the emulsion fuel composition according to the present invention, the incorporation of a water-soluble compound having in its molecule two or more hydroxyl groups and/or a monohydric alcohol having 6 or more carbon atoms, which are substantially free from components which give residual carbon and nitrogen after combustion, can contribute to a reduction in the contents of soot, dust and nitrogen oxides in the exhaust gas. Further, in the emulsion fuel composition according to the present invention, the incorporation of a water-soluble compound having in its molecule two or more hydroxyl groups and/or a monohydric alcohol having 6 or more carbon atoms raises the boiling point of the aqueous phase of the emulsion, thus elevating the steam explosion temperature. The elevation of the steam explosion temperature renders the steam explosion powerful, which atomizes oil droplets, i.e., the oil phase of the emulsion. As the result, it is believed that the soot and dust are reduced according to the reason described above. Further, the powerful steam explosion accelerates the scattering rate of atomized oil droplets, which enables the particles to pass through the high-temperature region in a short time. Hence, it is believed that the nitrogen oxides attributable to thermal $NO_x$ can be reduced.

As described above, the emulsion fuel composition of the present invention is an epochal fuel that enables heavy oils, which have not previously been utilized effectively as an energy source, such as bitumen and asphalt, to be used as a substitute fuel for the heavy fuel oil, and that has an improved versatility by virtue of the improvement in storage stability. Further, the emulsion fuel composition of the present invention is useful as a substitute fuel for the heavy fuel oil because the steam explosion during combustion is intensified to enhance the combustion efficiency and to reduce the amount of soot and dust after combustion.

EXAMPLES

The present invention will now be described in more detail with reference to the following Examples which should not be considered to limit to the scope of the present invention.

Example 1

210 g of an asphalt (specific gravity: 1.015, viscosity: 595 cP/100° C., softening point: 29° C., penetration: 370/25° C.) extracted from Arabian Light crude oil, 90 g of water, 1.5 g of a nonionic surfactant [polyoxyethylene nonylphenyl ether (average number of moles of addition of E0: 23); Emulgen 921 manufactured by Kao Corp.], 1.5 g of an artionic surfactant (potassium oleate soap; OS Soap manufactured by Kao Corp.) and glycerol (manufactured by Kao Corp.) or sorbitol (manufactured by Kao Corp.) as the polyhydric alcohol in respective amounts specified in Table 1 were mixed with one another at a temperature of 80° C. on a TK homomixer (provided with a low-viscosity agitation blade and manufactured by Tokushu Kika Kogyo Co., Ltd.) to prepare emulsions. In some cases, polyvinyl alcohol (PVA124 manufactured by Kuraray Co., Ltd.) was also used as the water-soluble polymer. The number of revolutions of the agitation blade was 8,000 rpm, and the agitation time was 3 min. The emulsions thus obtained were allowed to stand at 20° C. and then subjected to measurements of average particle diameter and viscosity and evaluation of standing stability at 20° C. Further, the emulsions were subjected to an evaluation of thermal stability at −5° to 20° C. The results are given in Table 1.

Methods of the measurement and evaluation were as follows.

Average particle diameter: measured with a laser beam diffraction/scattering particle size distribution measuring device (LA700 manufactured by Horiba, Ltd.). The average particle diameter is a median diameter.

Viscosity: one min after the initiation of rotation, the viscosity was measured with a Brookfield viscometer (model BM) manufactured by Tokyo Keiki Co., Ltd. using rotor No. 3 at 60 rpm.

Standing stability: one month after the initiation of standing, the state of the emulsion was observed by using a sedimentation test tube (100 cc) to evaluate the separation of water on the surface of the emulsion and the sedimentation in the lower layer according to 3 ranks (i.e., "significant", "somewhat" and "none").

Thermal stability: a temperature cycle of 20° C. (one day) and −5° C. (one day) was conducted using a sedimentation tube (100 cc) to evaluate the state of breaking of the emulsion one month after the initiation of the cycle.

(broken: separation of asphalt with water, stable: no change in appearance)

TABLE 1

| | | Results of measurement and evaluation | | | | | | | |
|---|---|---|---|---|---|---|---|---|---|
| | | polyhydric alcohol | | water-sol. | | | Standing stability | | |
| | Expt. No. | Kind | amt. of incorporation (g) | polymer used and amount thereof (g) | Av. particle diam. (μm) | Viscosity (cP) | separation of water on surface layer | sedimentn. | Thermal stability |
| Comp. Ex. | 1 | — | — | — | 8.2 | 720 | significant | significant | broken |
| Invention Ex. | 2 | glycerol | 3.0 | — | 8.0 | 880 | somewhat | none | stable |
| | 3 | glycerol | 30.0 | — | 9.1 | 1510 | none | none | stable |
| | 4 | sorbitol | 3.0 | — | 8.7 | 820 | somewhat | none | stable |
| | 5 | sorbitol | 30.0 | — | 7.7 | 1770 | none | none | stable |
| | 6 | glycerol | 3.0 | (PVA124) 1.0 | 6.0 | 970 | none | none | stable |
| | 7 | sorbitol | 3.0 | (PVA124) 1.0 | 6.4 | 950 | none | none | stable |

As is apparent from the results of measurement and evaluation given in Table 1, in Experiment No. 1, since no polyhydric alcohol was incorporated, the separation of water on the surface of the emulsion and sedimentation occurred one month after the initiation of standing, and the emulsion was broken in the thermal stability test at −5° to 20° C.

By contrast, in the systems of Experiment Nos. 2 to 7 of the present invention, since polyhydric alcohols were incorporated, both the standing stability and thermal stability were so good that the separation of water on the surface of the emulsion, sedimentation and breaking were prevented.

Example 2

About 4000 kg of emulsions were prepared using the same raw materials and mixing ratio as those in the production of the emulsion in Example 1 and were subjected to a combustion test.

The production of the emulsions was conducted as follows: The asphalt, water, the surfactant, the polyhydric alcohol and the water-soluble polymer were each heated to 80° C. and fed into a reaction vessel (vessel diameter: 1.9 m) having a capacity of 5 $m^3$, and the mixture was agitated at 80° C. for 60 min. A Pfaudler type impeller was used as the agitation blade, and the diameter and number of revolutions of the blade were 1.1 m and 64 rpm, respectively. After the completion of the premixing, the mixture was emulsified on a PL-SL line mixer manufactured by Tokushu Kika Kogyo Co., Ltd. according to a batch circulation system. The number of revolutions of the mixer and the emulsification time were 8600 rpm and 4 hrs, respectively. After the completion of the emulsification, the system was cooled to 20° C. over a period of about 10 hrs to provide an emulsion for a combustion test.

In the combustion test, a horizontal cylindrical double-wall water cooling experimental furnace (1.2 m $\phi \times 3.4$ m L); manufactured by Nippon Furnace Kogyo Co., Ltd.) was used to measure the content of soot and dust (JIS Z-8808) and the content of nitrogen oxides (JIS K-0104) in the exhaust gas. The results are given in Table 2.

| Combustion conditions were as follows: | |
|---|---|
| burner: | internal mixing type (manufactured by Nihon Furnace Kogyo Co., Ltd.) |
| atomizing steam: | temp. = 170° C., flow rate = 60 l/hr, pressure = 4.3 kg/$cm^2$ |
| emulsion fuel: | temp. = 50° C., flow rate = 150 l/hr, pressure = 3.8 kg/$cm^2$ |
| air flow rate: | 1230 $m^3$/hr |

TABLE 2

| | | Results of combustion test | | | | | | | |
|---|---|---|---|---|---|---|---|---|---|
| | | Polyhydric alcohol | | water sol. polymer used | | | Exhaust gas | | |
| | Expt. No. | Kind | amt. of incorporation (kg/4t) | and amount thereof (kg/4t) | Av. particle diam. (μm) | Viscosity (cP) | oxygen (%) | content of soot and dust (g/$m^3$) | content of nitrogen oxides (ppm) |
| Comp. Ex. | 1 | — | — | — | 12.4 | 720 | 4.1 | 0.14 | 262 |
| Invention Ex. | 2 | glycerol | 39 | — | 11.6 | 190 | 4.1 | 0.08 | 221 |
| | 3 | glycerol | 390 | — | 10.5 | 1320 | 4.0 | 0.06 | 210 |
| | 4 | sorbitol | 39 | — | 11.8 | 770 | 4.1 | 0.09 | 235 |
| | 5 | sorbitol | 390 | — | 12.3 | 1250 | 4.1 | 0.08 | 227 |
| | 6 | glycerol | 39 | (PVA124) 13 | 10.0 | 830 | 4.0 | 0.07 | 216 |
| | 7 | sorbitol | 39 | (PVA124) 13 | 10.4 | 910 | 4.1 | 0.07 | 223 |

As is apparent from Table 2, in the emulsion of Experiment No. 1 as a comparative example, since no polyhydric alcohol was incorporated, the content of soot and dust and the content of nitrogen oxides were 0.14 g/$m^3$ and 262 ppm, respectively.

By contrast, in Experiments Nos. 2 to 7 of the present invention, since polyhydric alcohols were incorporated, the content of soot and dust and the content of nitrogen oxides were much lower than those of the Experiment No. 1, so that it can be said that these emulsion fuel compositions are lesspollutive.

Example 3

The following materials were used as the raw materials for producing heavy oil emulsion fuel compositions:

asphalt: one extracted from Arabian Light crude oil (specific gravity: 1.015, viscosity: 595 cP/100° C., softening point: 29° C., penetration: 370/25° C.)

water: deionized water nonionic surfactant: polyoxyethylene nonyl-phenyl ether (average number of moles of added EO: 28 mol) (Emulgen 921 manufactured by Kao Corp.)

anionic surfactant: formaldehyde condensate of naphthalenesulfonic acid (weight average molecular weight: 13,000) (Mighty 150 manufactured by Kao Corp.)

monohydric alcohol having 6 or more carbon atoms: stearyl alcohol (Kalcol 80 manufactured by Kao Corp.)

lower alcohol: butyl alcohol (extrapure reagent; manufactured by Wako Pure Chemical Industries, Ltd.)

water-soluble polymer: carboxymethylcellulose (CMCl190 manufactured by Daicel Chemical Industries, Ltd.)

polyhydric alcohol: glycerol (manufactured by Kao Corp.)

The above-described raw materials were weighed as specified in Table 3 and each heated at 80° C. Thereafter, the monohydric alcohol having 6 or more carbon atoms was dissolved in asphalt, and the water-soluble polymer and the polyhydric alcohol were dissolved in water. Thereafter, while maintaining the temperature at 80° C., emulsions were prepared by using a TK homomixer (provided with a low-viscosity agitation blade and manufactured by Tokushu Kika Kogyo Co., Ltd.) under a number of revolutions of agitation blade of 8000 rpm and an agitation time of 3 min. The emulsions as prepared were allowed to stand at 20° C. for 24 hrs and then subjected to the measurement of average particle diameter and viscosity and the evaluations of storage stabilities, i.e., the standing stability and the thermal stability. The results are given in Table 4.

The measurement and evaluation methods were the same as those of Example 1.

TABLE 3

| | Expt. No. | Asphalt (g) | Water (g) | Nonionic surfactant (g) | Anionic surfactant (g) | Monohydric alcohol (g) | Lower alcohol (g) | Water-sol. polymer (g) | Polyhydric alcohol (g) |
|---|---|---|---|---|---|---|---|---|---|
| Comp. Ex. | 1 | 210 | 90 | 1.5 | 1.5 | — | — | — | — |
| | 2 | 210 | 90 | 1.5 | 1.5 | — | 3.0 | — | — |
| Invention | 3 | 207 | 90 | 1.5 | 1.5 | 3.0 | — | — | — |
| Ex. | 4 | 180 | 90 | 1.5 | 1.5 | 30.0 | — | — | — |
| | 5 | 207 | 90 | 1.5 | 1.5 | 3.0 | — | 0.3 | — |
| | 6 | 180 | 90 | 1.5 | 1.5 | 30.0 | — | 0.3 | — |
| | 7 | 200 | 90 | 1.5 | 1.5 | 3.0 | — | — | 7.0 |
| | 8 | 200 | 90 | 1.5 | 1.5 | 3.0 | — | 0.3 | 7.0 |

TABLE 4

| | Results of measurement and evaluation | | | | |
|---|---|---|---|---|---|
| | | | | Standing stability | |
| | Expt. No. | Av. particle diam. (μm) | Viscosity (cP) | separation of water on surface layer | sedimentation |
| Comp. Ex. | 1 | 8.6 | 910 | Significant | Somewhat |
| | 2 | 8.8 | 870 | Significant | Somewhat |
| Invention | 3 | 7.7 | 910 | None | None |
| Ex. | 4 | 7.9 | 870 | None | None |
| | 5 | 8.3 | 850 | None | None |
| | 6 | 7.5 | 940 | None | None |
| | 7 | 8.0 | 730 | None | None |
| | 8 | 8.1 | 800 | None | None |

As is apparent from the results of the evaluation of the stability given in Table 4, in Experiment Nos. 1 and 2 as comparative examples, since no monohydric alcohol having 6 or more carbon atoms was incorporated, water separation occurred on the surface of the emulsion and sedimentation was observed at the bottom of the emulsion one month after the initiation of standing, so that it can be said that these emulsions have poor stability.

By contrast, in the systems of Experiment Nos. 3 to 8 of the present invention, since the monohydric alcohol having 6 or more carbon atoms or, the monohydric alcohol having 6 or more carbon atoms and the water-soluble polymer and/or the polyhydric alcohol were incorporated, the standing stability was very good and, even one month after the initiation of standing, neither water separation nor sedimentation on the bottom of emulsion occurred, so that it can be said that these emulsions have good stability.

Example 4

About 4000 kg of emulsions were prepared using the same raw materials and mixing ratio as those in the preparation of the emulsion in Example 3 and were subjected to a combustion test in the same manner as that of Example 2. The results are given in Table 5.

TABLE 5

| | Expt. No. | Av. particle diam. (μm) | Viscosity (cP) | Results of combustion test: Exhaust gas: oxygen (%) | content of soot and dust ($g/m^3$) | content of nitrogen oxides (ppm) |
|---|---|---|---|---|---|---|
| Comp. Ex. | 1 | 11.5 | 740 | 4.2 | 0.14 | 250 |
| | 2 | 11.3 | 700 | 4.0 | 0.13 | 248 |
| Invention Ex. | 3 | 12.1 | 710 | 4.1 | 0.11 | 226 |
| | 4 | 11.8 | 820 | 4.2 | 0.05 | 183 |
| | 5 | 10.6 | 810 | 3.9 | 0.10 | 235 |
| | 6 | 11.0 | 840 | 4.0 | 0.05 | 180 |
| | 7 | 12.7 | 750 | 4.2 | 0.09 | 216 |
| | 8 | 12.6 | 730 | 4.1 | 0.08 | 203 |

As is apparent from the results of the combustion test given in Table 5, in the emulsion fuel compositions of Experiment Nos. 1 and 2 as comparative examples, since no monohydric alcohol having 6 or more carbon atoms was incorporated, the content of soot and dust and the content of nitrogen oxides were 0.13 to 0.14 $g/m^3$ and 248 to 250 ppm, respectively.

By contrast, in Experiment Nos. 3 to 8 of the present invention, since the monohydric alcohol having 6 or more carbon atoms or, the monohydric alcohol having 6 or more carbon atoms and the water-soluble polymer and/or the polyhydric alcohol were incorporated, a marked reduction in the content of soot and dust and the content of nitrogen oxides was observed, so that it can be said that these emulsion fuel compositions are lesspollutive.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A heavy oil emulsion fuel composition comprising (a) a heavy oil, (b) water, (c) a surfactant and (d) a mixture of a water-soluble compound having two or more hydroxyl groups and a monohydric alcohol having 6 or more carbon atoms.

2. The heavy oil emulsion fuel composition according to claim 1, wherein the contents of (a) the heavy oil, (b) the water, (c) the surfactant and (d) the component selected from the group consisting of water-soluble compounds having in its molecule two or more hydroxyl groups, monohydric alcohols having 6 or more carbon atoms, and mixtures thereof are, based on the entire amount of components (a) to (d), 40 to 85% by weight, 10 to 40% by weight, 0.1 to 5% by weight and at least 0.1% by weight, respectively.

3. The heavy oil emulsion fuel composition according to claim 2, wherein the content of component (d) is 0.1 to 49.9% by weight based on the entire amount of components (a) to (d).

4. The heavy oil emulsion fuel composition according to claim 2, wherein component (d) is at least one component selected from the group consisting of water-soluble compounds having in its molecule two or more hydroxyl groups.

5. The heavy oil emulsion fuel composition according to claim 4, wherein the content of component (d) is 0.1 to 50% by weight based on the entire amount of components (a) to (d).

6. The heavy oil emulsion fuel composition comprising (a) heavy oil, (b) water, (c) a surfactant, (d) a mixture of a water-soluble compound having two or more hydroxyl groups and a monohydric alcohol having 6 or more carbon atoms, and (e) a water-soluble polymer having a molecular weight (Mw) of 10,000 or more.

7. The heavy oil emulsion fuel composition according to claim 6, wherein the content of the water-soluble polymer having a molecular weight (Mw) of 10,000 or more is 0.005 to 3% by weight based on the entire amount of components (a) to (d).

8. The heavy oil emulsion fuel composition according to claim 1, wherein (c) the surfactant comprises a nonionic surfactant.

9. The heavy oil emulsion fuel composition according to claim 1, wherein (c) the surfactant comprises a nonionic surfactant and an anionic surfactant.

10. The heavy oil emulsion fuel composition according to claim 1, which further comprises at least one component selected from the group consisting of fats and oils, fatty acids and fatty acid esters.

11. The heavy oil emulsion fuel composition according to claim 10, wherein the content of the component selected from the group consisting of fats and oils, fatty acids and fatty acid esters is 1 to 50% by weight based on the entire amount of components (a) to (d).

* * * * *